US007549894B1

(12) United States Patent
Wang

(10) Patent No.: US 7,549,894 B1
(45) Date of Patent: Jun. 23, 2009

(54) WALL PLATE ASSEMBLY

(75) Inventor: Chang-Pin Wang, Yung-Ho (TW)

(73) Assignee: Sure-Fire Electrical Corporation, Taipei Hsien (TW)

( * ) Notice: Subject to any disclaimer, the term of this patent is extended or adjusted under 35 U.S.C. 154(b) by 0 days.

(21) Appl. No.: 11/956,320

(22) Filed: Dec. 13, 2007

(51) Int. Cl.
*H01R 33/945* (2006.01)

(52) U.S. Cl. ..... 439/577

(58) Field of Classification Search ..... 439/577, 439/536, 623, 660, 535; 385/53, 88; 379/390.02, 379/438; 725/127, 134
See application file for complete search history.

(56) References Cited

U.S. PATENT DOCUMENTS

| | | | | |
|---|---|---|---|---|
| 6,543,940 | B2 * | 4/2003 | Chu | 385/53 |
| 6,854,895 | B2 * | 2/2005 | Coffey et al. | 385/53 |
| 2007/0190857 | A1 * | 8/2007 | Galang et al. | 439/607 |

* cited by examiner

*Primary Examiner*—Alexander Gilman

(57) ABSTRACT

A wall plate assembly includes a wall plate having an insertion slot, and a signal adapter that is affixed to the back side of the wall plate and has a HDMI jack attached to the insertion slot of the wall plate for receiving a HDMI plug of a HDMI cable and an adapter module with RJ type module jacks electrically connected to the HDMI jack for the connection of RJ type cables for long distance signal transmission without signal attenuation.

12 Claims, 19 Drawing Sheets

WALL PLATE ASSEMBLY

BACKGROUND OF THE INVENTION

1. Field of the Invention

The present invention relates to a wall plate structure and more particularly, to a wall plate assembly that has a signal adapter with a HDMI jack and a set of RJ type module jacks for long distance video signal transmission without attenuation.

2. Description of the Related Art

Following fast development of high technology, high picture quality and high contrast LCD TVs and plasma TVs are continuously created and put into market to substitute for conventional CRT (cathode ray tube) TVs. In consequence, the number of TV channels has also been greatly increased from a few numbers to more than one hundred. However, TV programs do not fit all people. Therefore, video tapes are created for recording video programs for replay by means of a video tape player or video tape recorder and player. However, video tapes have a big dimension, are not easy to keep, and tend to be damaged by moisture. Therefore, video tapes are soon eliminated from the market in the flow of the times.

Nowadays, VCDs and DVDs are intensively used for storing movies, and used with VCD/DVD players for replay of storage movies. When a VCD/DVD player is used, a signal cable shall be installed to connect the VCD/DVD player to a TV for A/V signal output. Previously, DVI (Digital Video Interleaved) technique was employed for video signal transmission, and Intel i750 VLSI (Very-large-scale integration) was employed for compression/decompression. Because a DVI signal line can only transmit video signal, a speaker must be added for audio output. This wiring process is complicated and inconvenient.

In view of the aforesaid drawbacks, HDMI (High Definition Multimedia Interface) technology is developed. HDMI adopts HDCP that is a specification developed by Intel Corporation on 2002 to protect digital entertainment content across the DVI/HDMI interface. The HDCP specification provides a robust, cost-effective and transparent method for transmitting and receiving digital entertainment content to DVI/HDMI-compliant digital displays. HDMI is an all-digital audio/video interface capable of transmitting uncompressed streams. HDMI provides an interface between any compatible digital audio/video source, such as a set-top box, a DVD player, or the like and a compatible digital audio and/or video monitor, such as digital television. HDMI supports many digital video formats including SXGA, UXGA, SDTV and HDTV, and digital audio formats including CD/DVD-Audio and Dolby Digital/DTS. HDMI is capable of transmitting 8-channel compressed or non-compressed digital audio signals at a time, eliminating an extra sound source cable and simplifying wiring arrangement. HDMI transmission speed can be as high as 5 Gbps. When comparing to DVI's 8-bit color depth, HDMI provies 48-bit color depth for every prime color.

Following the step of high technology, many new electronic products are created. Installation of new electronic produces in houses requires extra installation spaces and wirings It is neither beautiful nor safe to directly arrange cables and related component parts on the wall, ceiling or floor is neither. For the sake of sense of beauty and safety, cables are preferably embedded in the wall, ceiling or floor, and wall plates with different kinds of jacks or connectors are provided on the surface of the wall, ceiling or floor and connected with the embedded cables for the connection of external electronic products.

In the computer world, HDMI is already found on many peripherals and a few newer video cards, with adoption rapidly increasing. However, if a high frequency transmission line is connected to multiple users through a router and the receiver is spaced from the transmitter at a long distance, the strength of the signal being transmitted through the transmission line will be attenuated, causing video signal distorsion or interruption. Therefore, the application of a high frequency transmission line is limited. HDMI is a fragile interface, not least because of the difficulties of manufacturing twisted-pair cable to the fine tolerances required to handle the extraordinary bandwidth requirements of the HDMI signal. During wiring of a HDMI cable within a wall or floor, the conductors may be stretched to break. When connecting the HDMI cable to a wall plate during wiring, it is hard to wind round the excessive length of the cable.

Therefore, it is desirable to provide a HDMI compatible wall plate assembly that eliminates the aforesaid problems.

SUMMARY OF THE INVENTION

The present invention has been accomplished under the circumstances in view. According to one aspect of the present invention, the wall plate assembly comprises a wall plate and a signal adapter fixedly provided at the back side of the wall plate. The wall plate comprises at least one insertion slot cut through front and back sides thereof for the insertion of a HDMI (High-Definition Multimedia Interface) plug respectively. The signal adapter comprises a base frame affixed to the back side of the wall plate, a circuit board mounted on the base frame, at least one HDMI (High-Definition Multimedia Interface) jack installed on the circuit board and respectively attached to the at least one insertion slot of the wall plate for receiving a respective HDMI plug, and an adapter module installed on the circuit board and electrically connected to the at least one HDMI jack for the connection of at least one RJ type cable. For long distance signal transmission, the use of a RJ type cable eliminates signal attenuation.

According to another aspect of the present invention, the invention uses the RJ type cables to connect the RJ type module jacks of the adapter modules of the signal adapters of two wall plate assemblies that are arranged at two locations far apart. Because the RJ type cables have the characteristics of high flexibility and small diameter, the wiring arrangement of the RJ type cables is easy. Further, if the RJ type cables are too long, they can be wound round to shorten the length and the part that is wound part can be received in a box in the wall or ceil holding the wall plate assembly. Further, because the cost of a RJ type cable is much lower than a HDMI cable, the use of the RJ type cables for connection between the RJ type module jacks of the adapter modules of the signal adapters of two wall plate assemblies saves much the installation cost.

DETAILED DESCRIPTION OF THE PREFERRED EMBODIMENT

Figure 1:
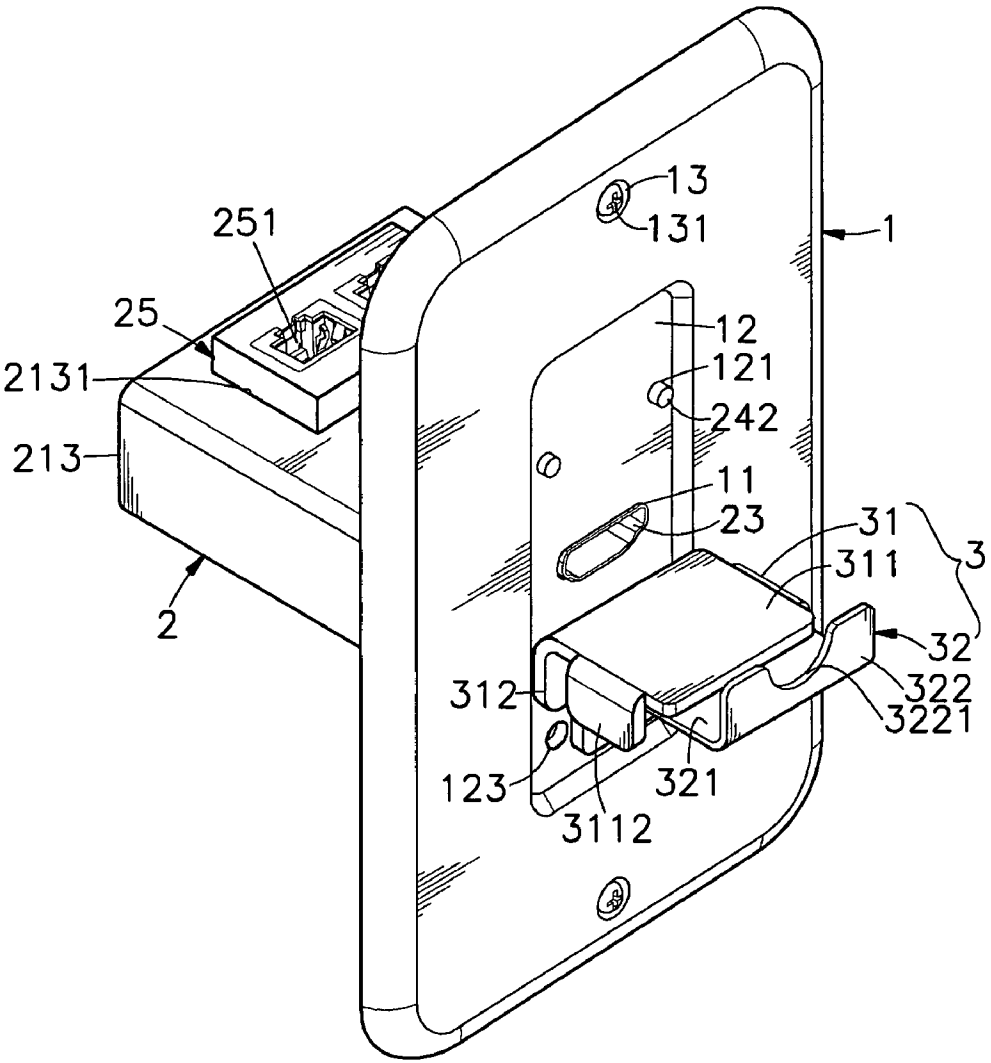
FIG. 1 is an oblique elevation of a wall plate assembly in accordance with the present invention.
Figure 2:
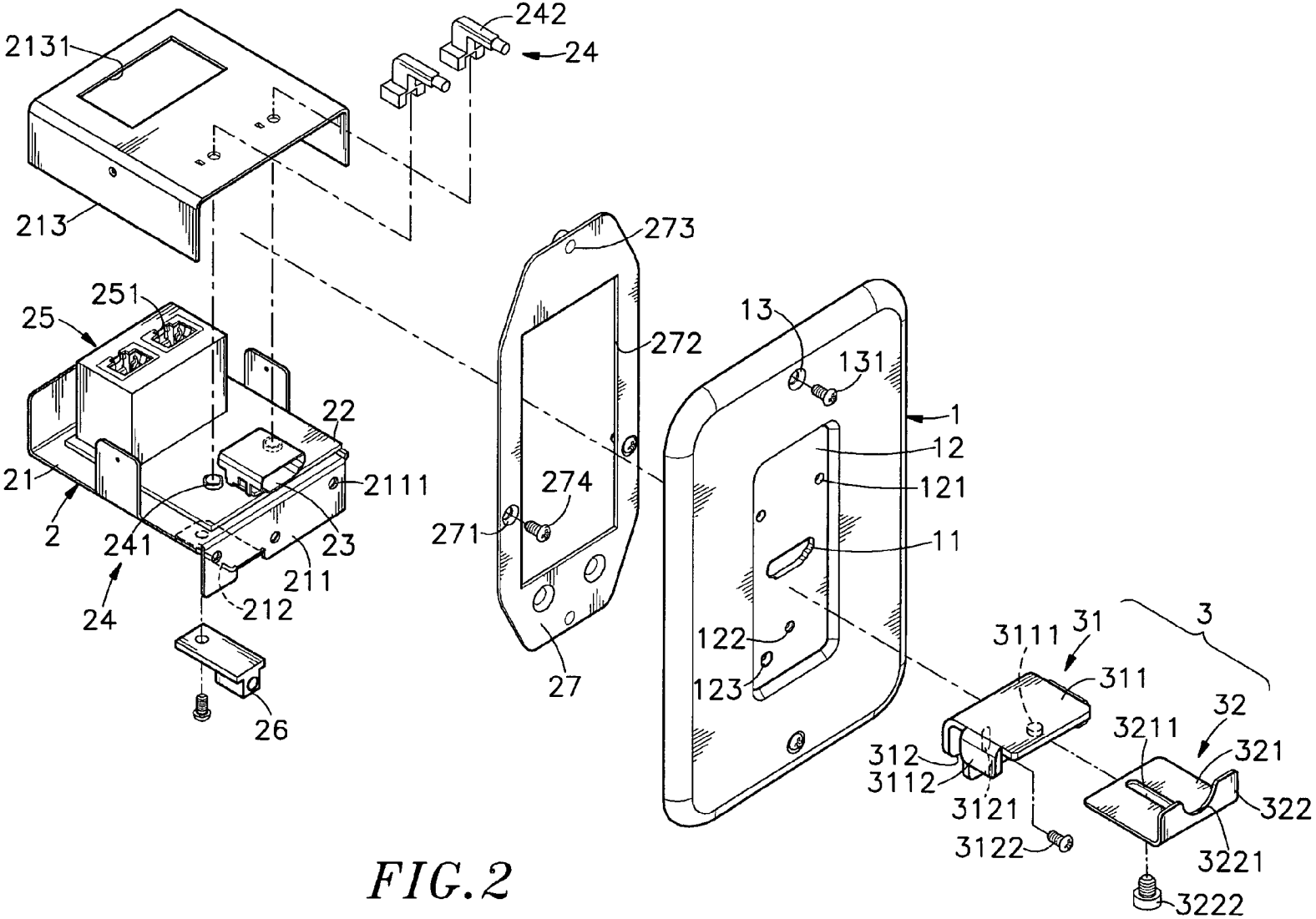
FIG. 2 is an exploded view of the wall plate assembly in accordance with the present invention.
Figure 3:
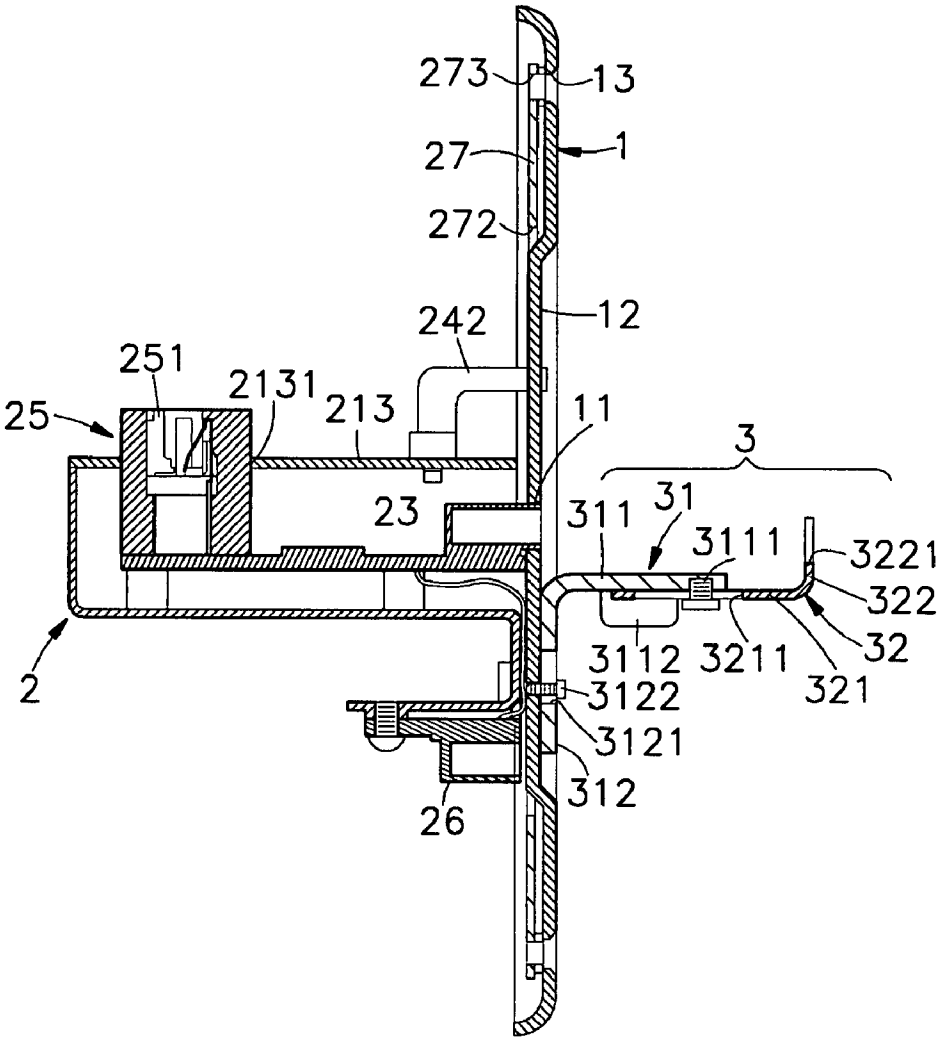
FIG. 3 is a sectional side view of the wall plate assembly according to the present invention.

Referring to FIGS. 1~3, a wall plate assembly for electric socket in accordance with the present invention is shown comprising a wall plate 1 and a signal adapter 2.

Figure 7:
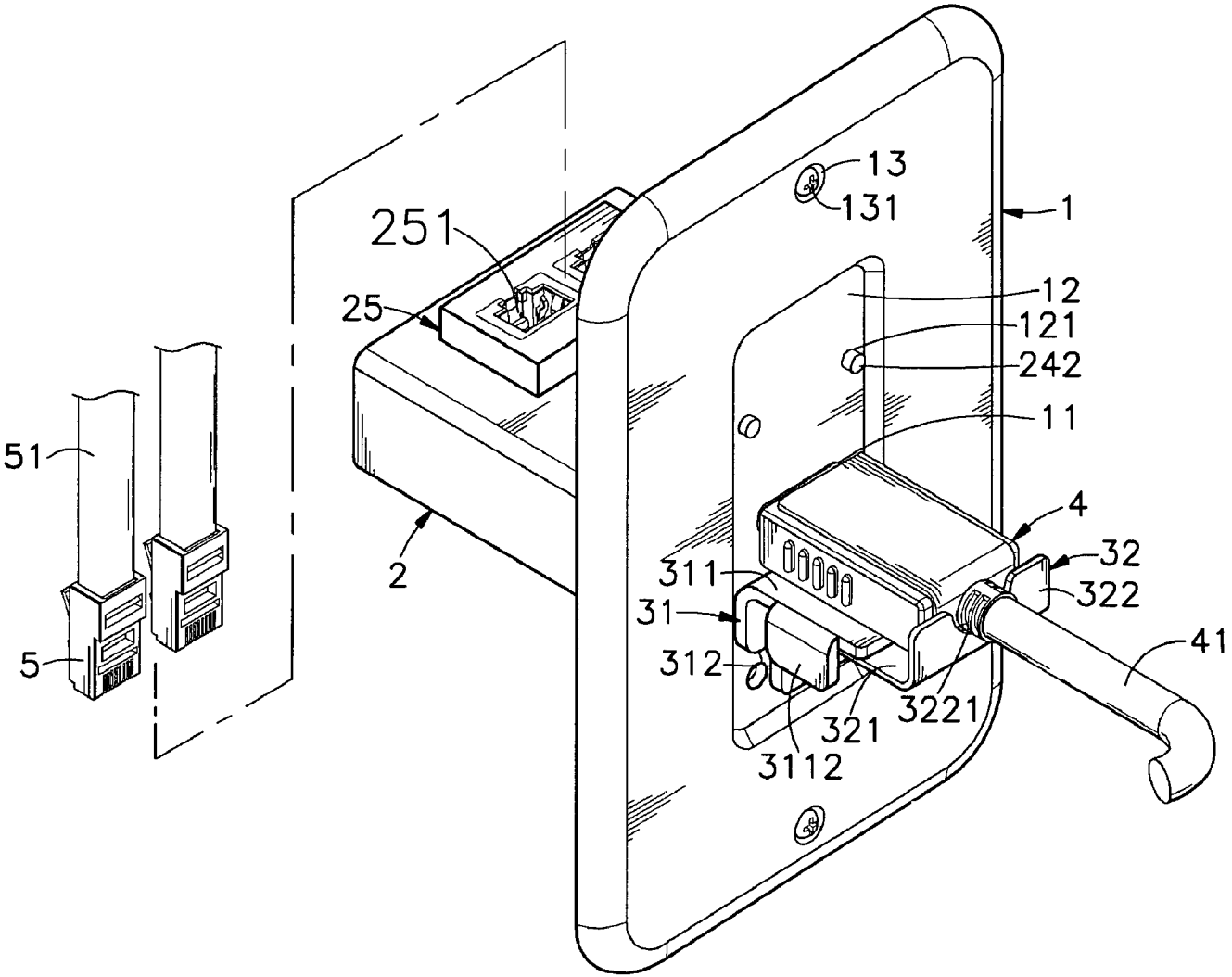
FIG. 7 is an oblique elevation of an alternate form of the wall plate assembly according to the present invention.

The wall plate 1 has a front recess 12 on it front side, an insertion slot 11 cut through the front recess 12 on the middle for the insertion of a HDMI (High Definition Multimedia Interface) plug 4 (see also FIG. 7), a plurality of through holes 121 and a screw hole 122 and a power plug hole 123 cut through the front recess 12 at selected locations, and a plurality of mounting through holes 13 cut through the front and back sides beyond the front recess 12 and respectively provided with a respective fastening member, for example, screw 131 for fastening to a wall.

The signal adapter 2 comprises a base frame 21 that has a front mounting panel 211 downwardly extending from its front side, a plurality of mounting through holes 2111 on the front mounting panel 211, and a lug 212 backwardly extending from the front mounting panel 211, a circuit board 22 mounted on the top side of the base frame 21, a HDMI jack 23 mounted on the circuit board 22 and protruding over the front side of the base frame 21, a LED indicator module 24 that comprises a plurality of LEDs (light emitting diodes) 241 and a plurality of light guides 242 corresponding to the LEDs 241, an adapter module 25 that is mounted on the circuit board 22 and comprises a plurality of RJ type module jacks 251, a power socket 26 affixed to the lug 212, and a mounting plate 27. The mounting plate 27 has a rectangular opening 272 which receives the back protruding part of the wall plate 1 corresponding to the front recess 12, a plurality of locating holes 271 respectively fastened to the mounting through holes 2111 of the front mounting panel 211 of the base frame 21 with respective screws 274, and a plurality of mounting through holes 273 corresponding to the mounting through holes 13 of the wall plate 1.

During installation, the screws 131 are respectively inserted through the mounting through holes 13 of the wall plate 1 and the mounting through holes 273 of the mounting plate 27 to affix the mounting plate 27 and the wall plate 1 to the wall, holding the signal adapter 2 in a hole (not shown) inside the wall and behind the wall plate 1. After installation, the HDMI jack 23 is connected to the back side of the insertion slot 11 of the wall plate 1 for receiving a HDMI plug (not shown), and the light guides 242 are respectively connected to the through holes 121 of the wall plate 1 to guide light from the LEDs 241 to the through holes 121 of the wall plate 1, and the power socket 26 is connected to the back side of the power plug hole 123 of the wall plate 1 for receiving a power plug (not shown).

Referring to FIGS. 1~3 again, the signal adapter 2 further comprises a cover plate 213 covered on the base frame 21 to protect the circuit board 22, the HDMI jack 23, the LEDs 241 of the LED indicator module 24 and the adapter module 25. The cover plate 213 has an opening 2131 corresponding to the RJ type module jacks 251 of the adapter module 25. The base frame 21 and the cover plate 213 are separately made and then fastened together. Alternatively, the base frame 21 and the cover plate 213 can be made in integrity to accommodate the circuit board 22, the HDMI jack 23, the LED indicator module 24 and the adapter module 25, allowing connection of respective matching connectors to the HDMI jack 23 and the RJ type module jacks 251 of the adapter module 25.

Figure 4:
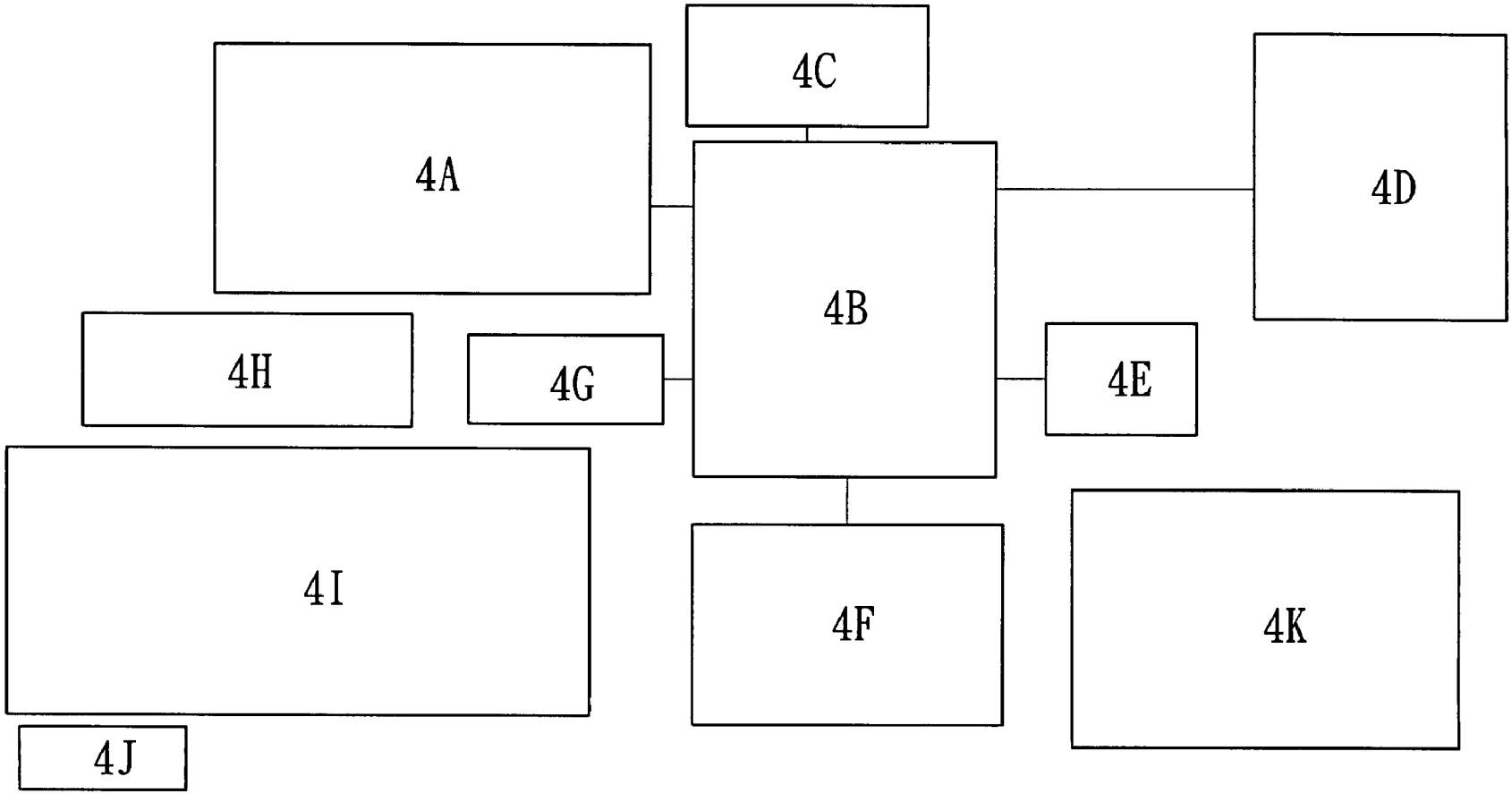
FIG. 4 is a diagram of a circuit according to the present invention, showing how FIGS. 4A~4K mate together.
Figure 4A:
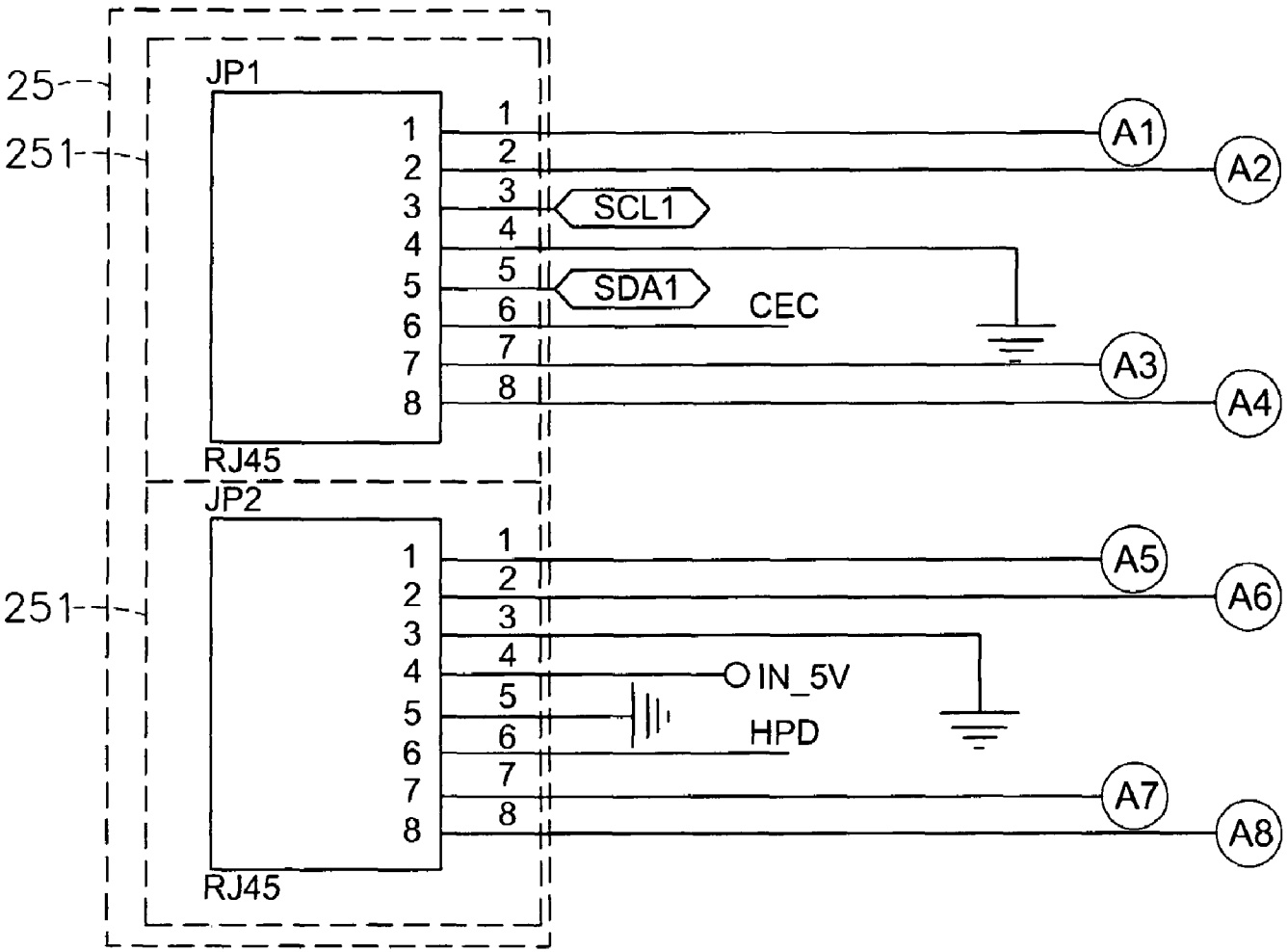
FIGS. 4A~4K together form FIG. 4.
Figure 4B:
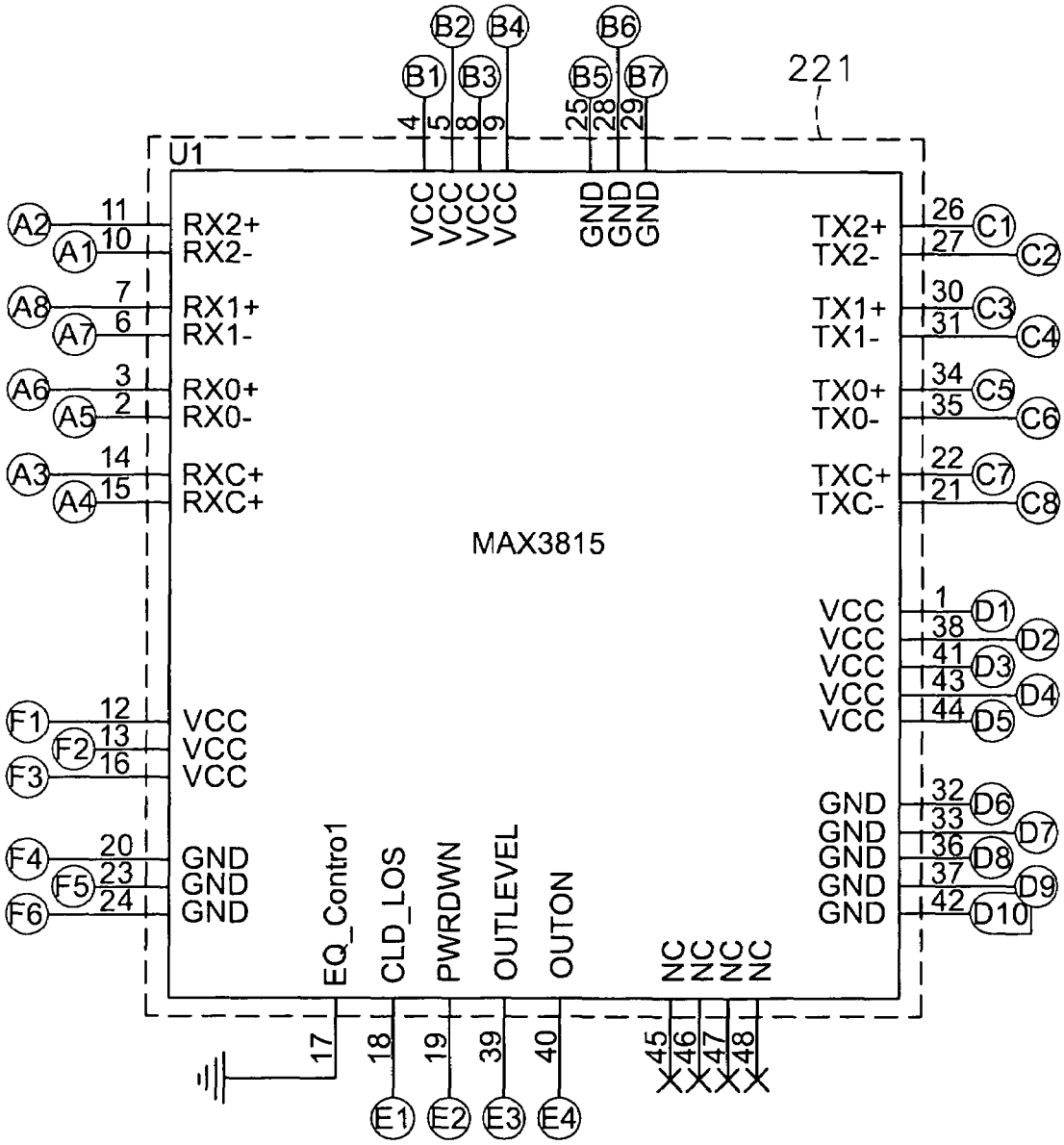
Figure 4C:
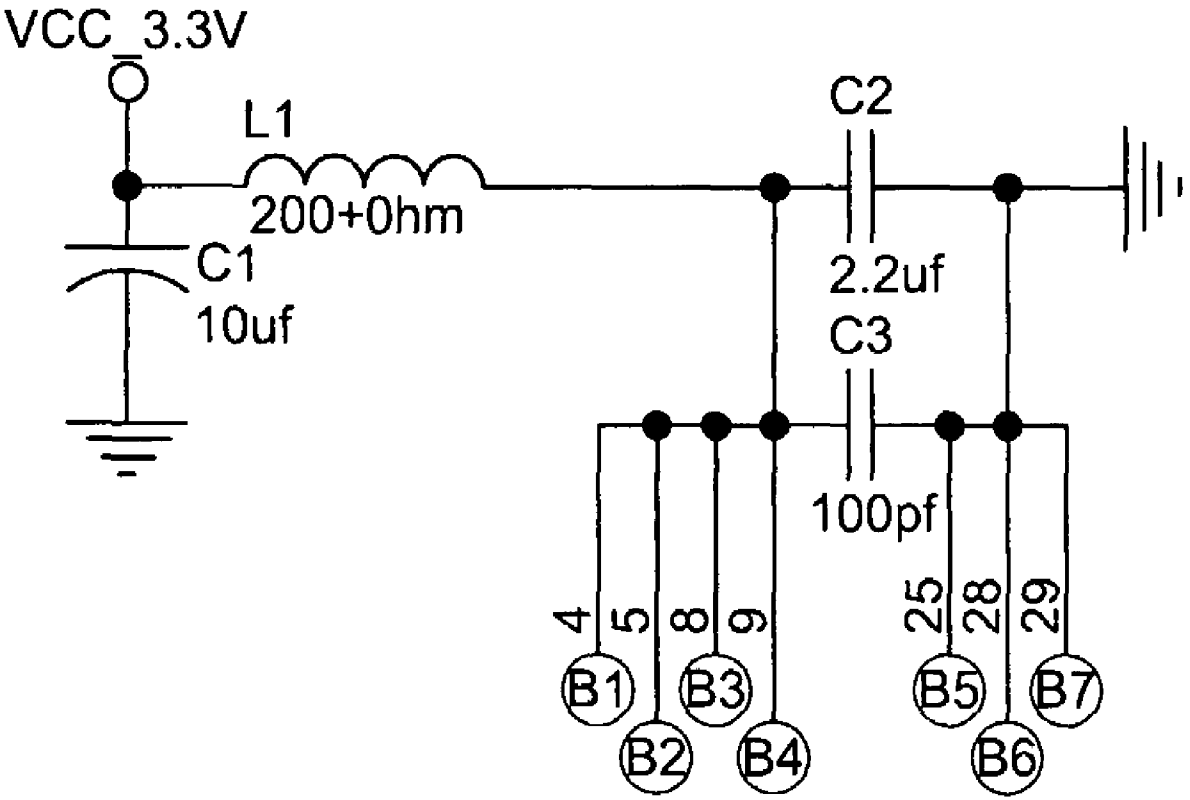
Figure 4D:
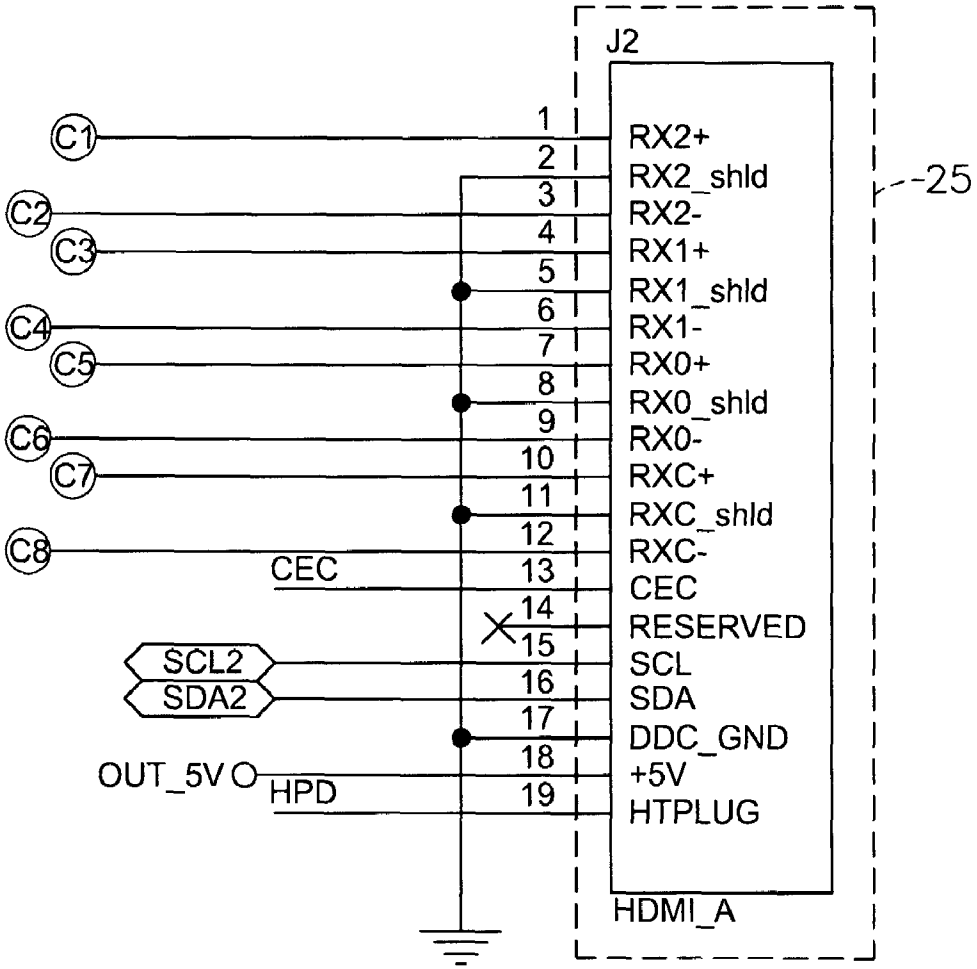
Figure 4E:
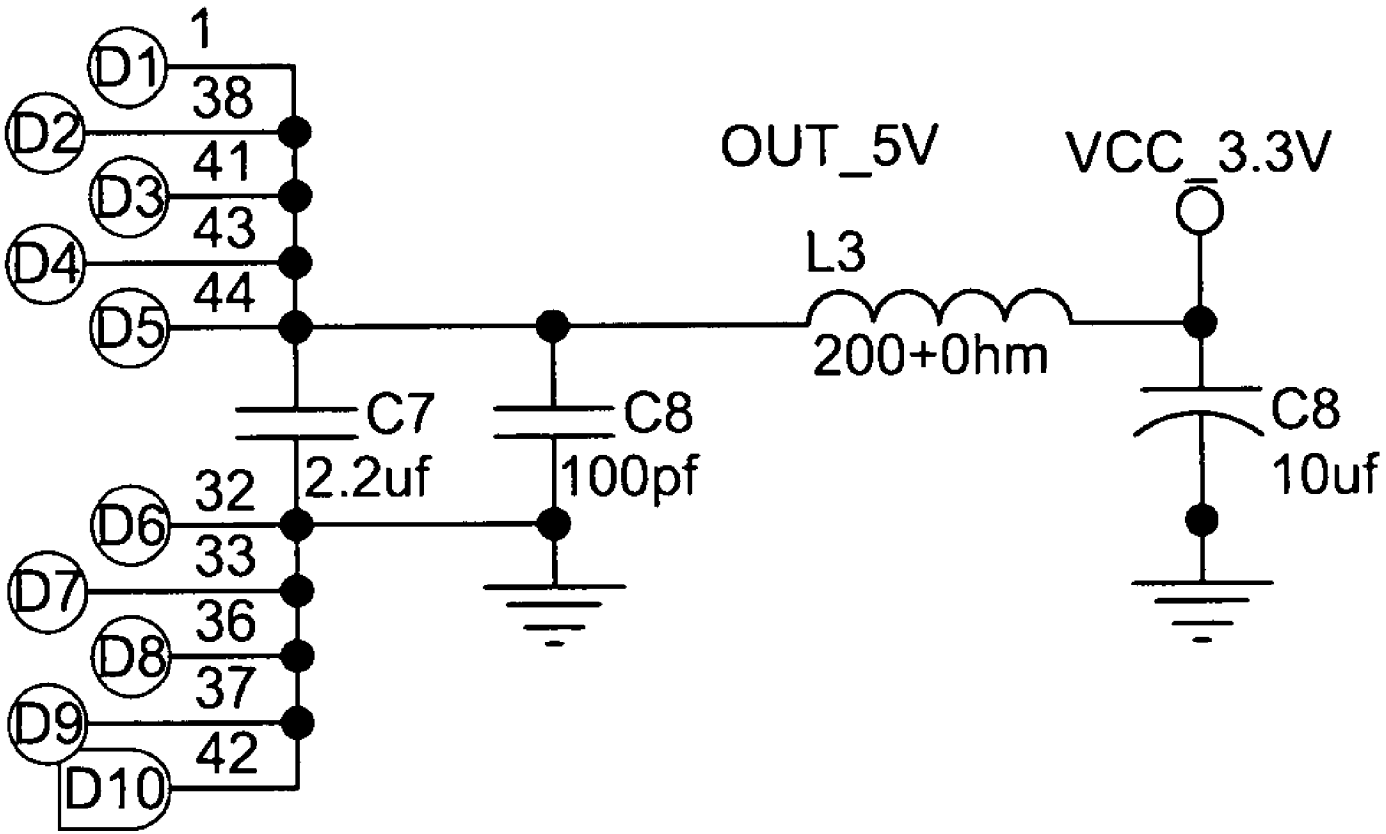
Figure 4F:
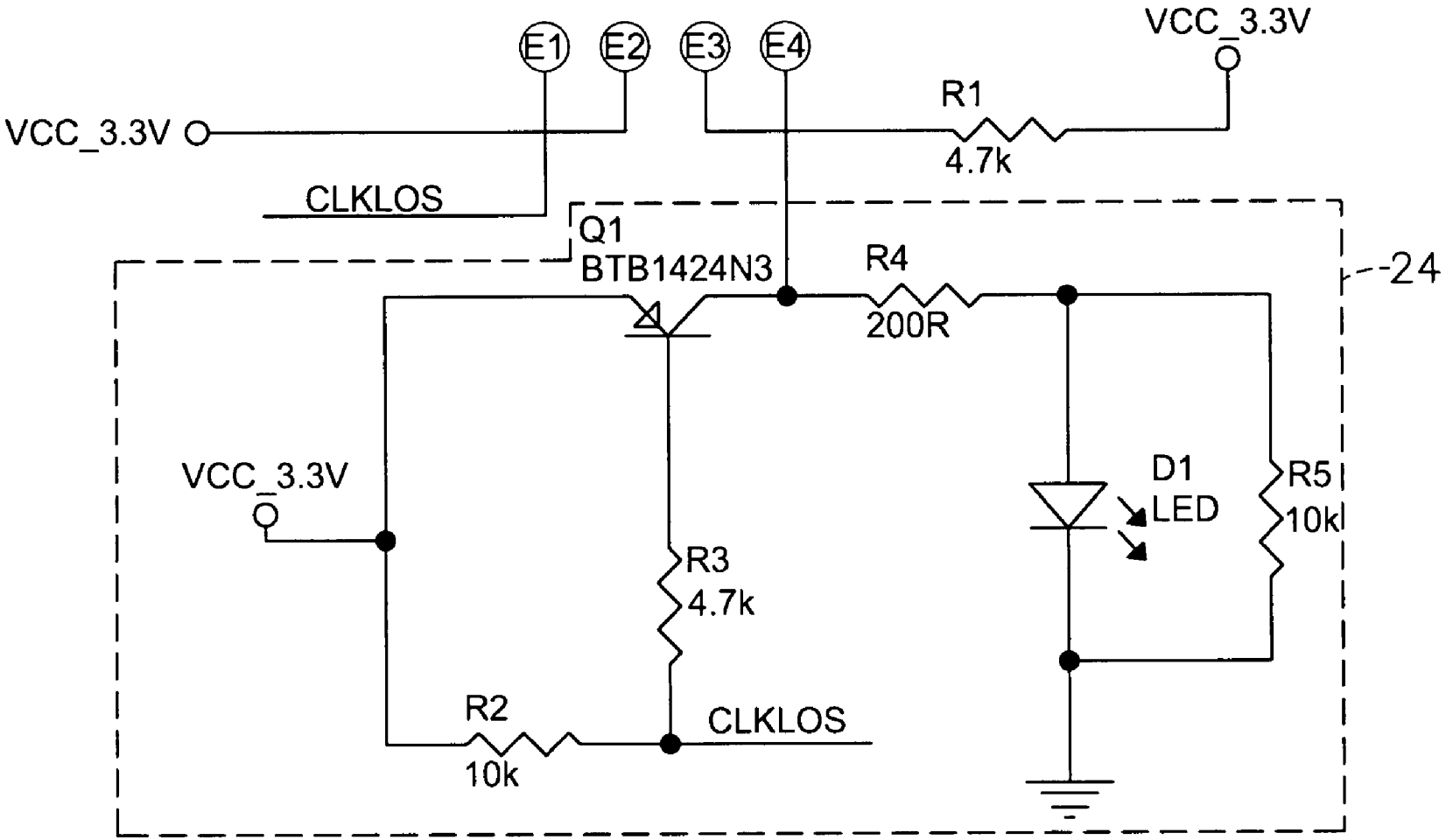
Figure 4G:
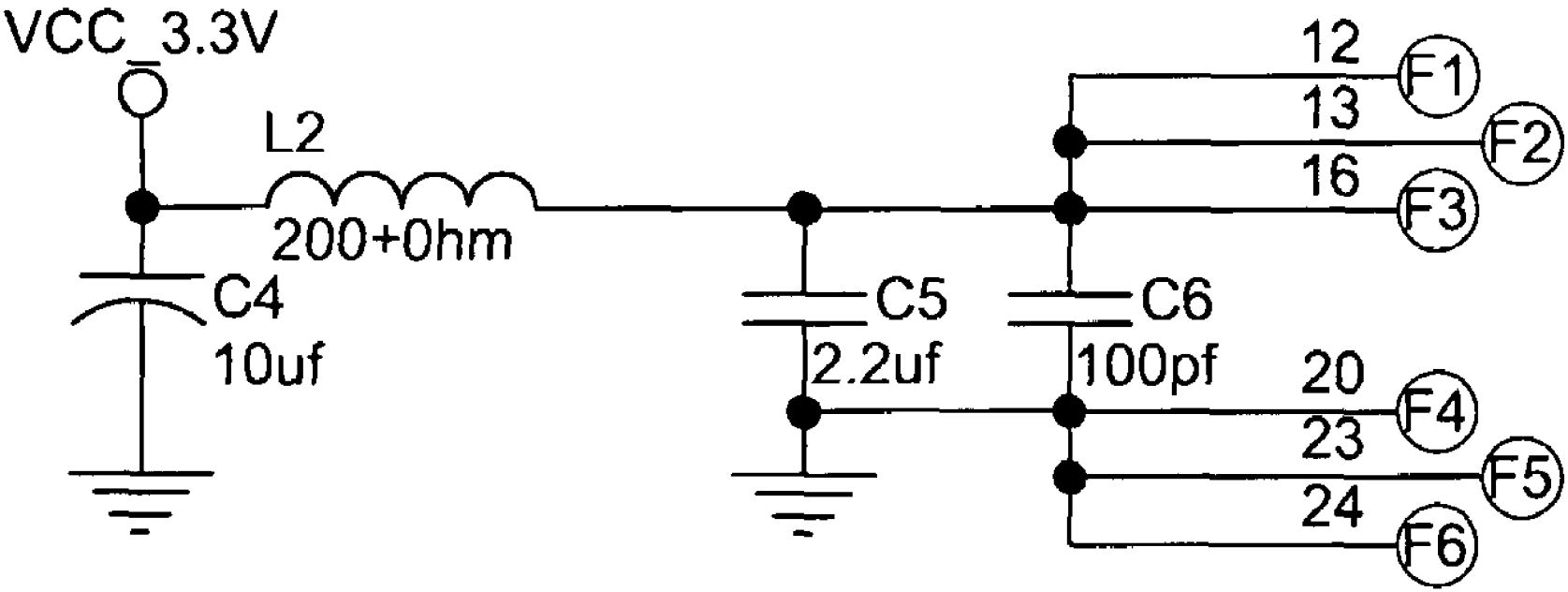
Figure 4H:
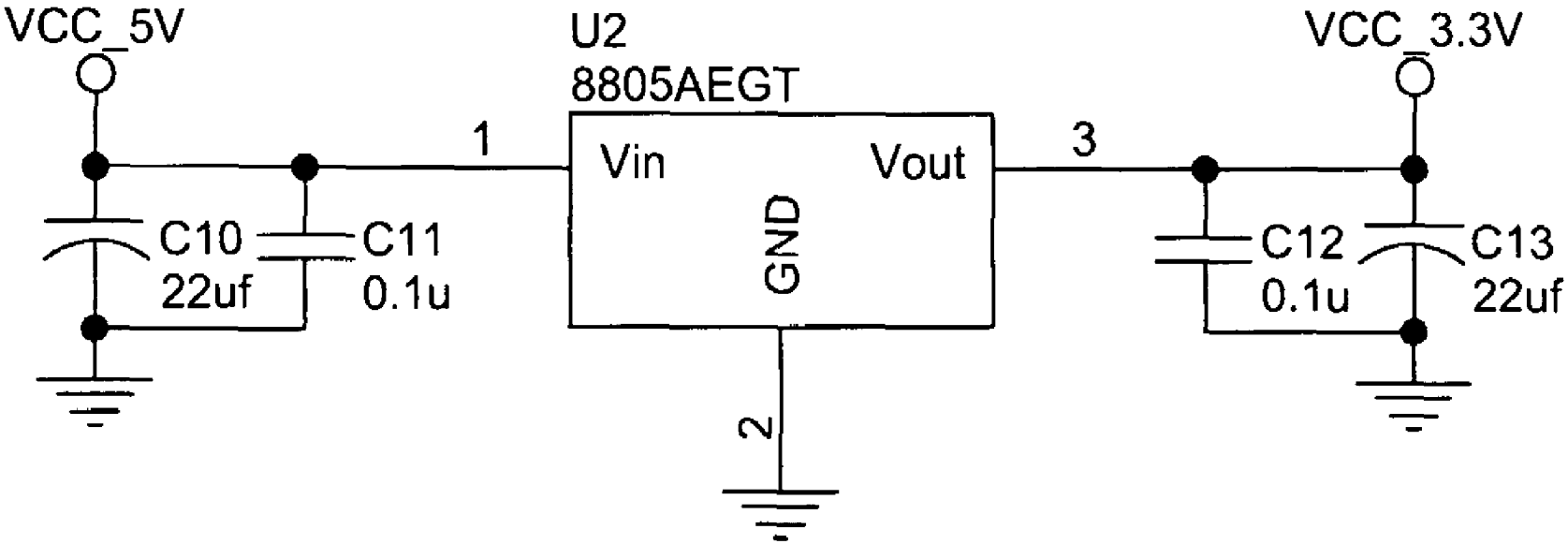
Figure 4I:
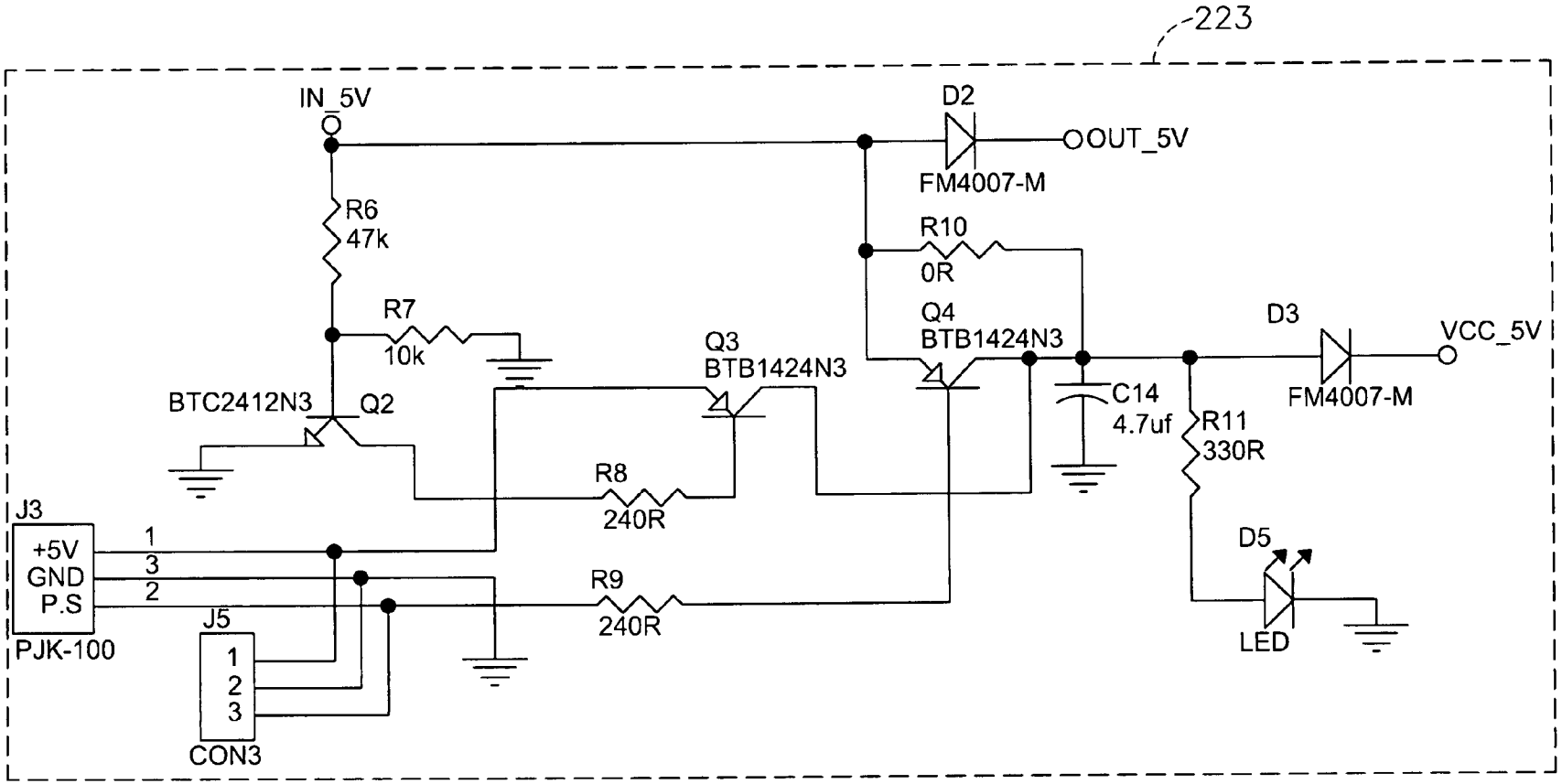
Figure 4J:
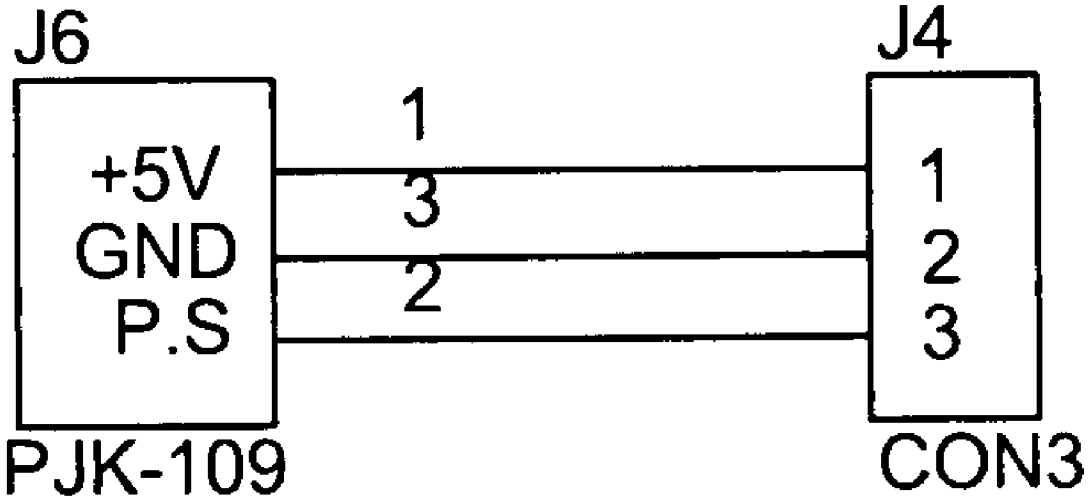
Figure 4K:
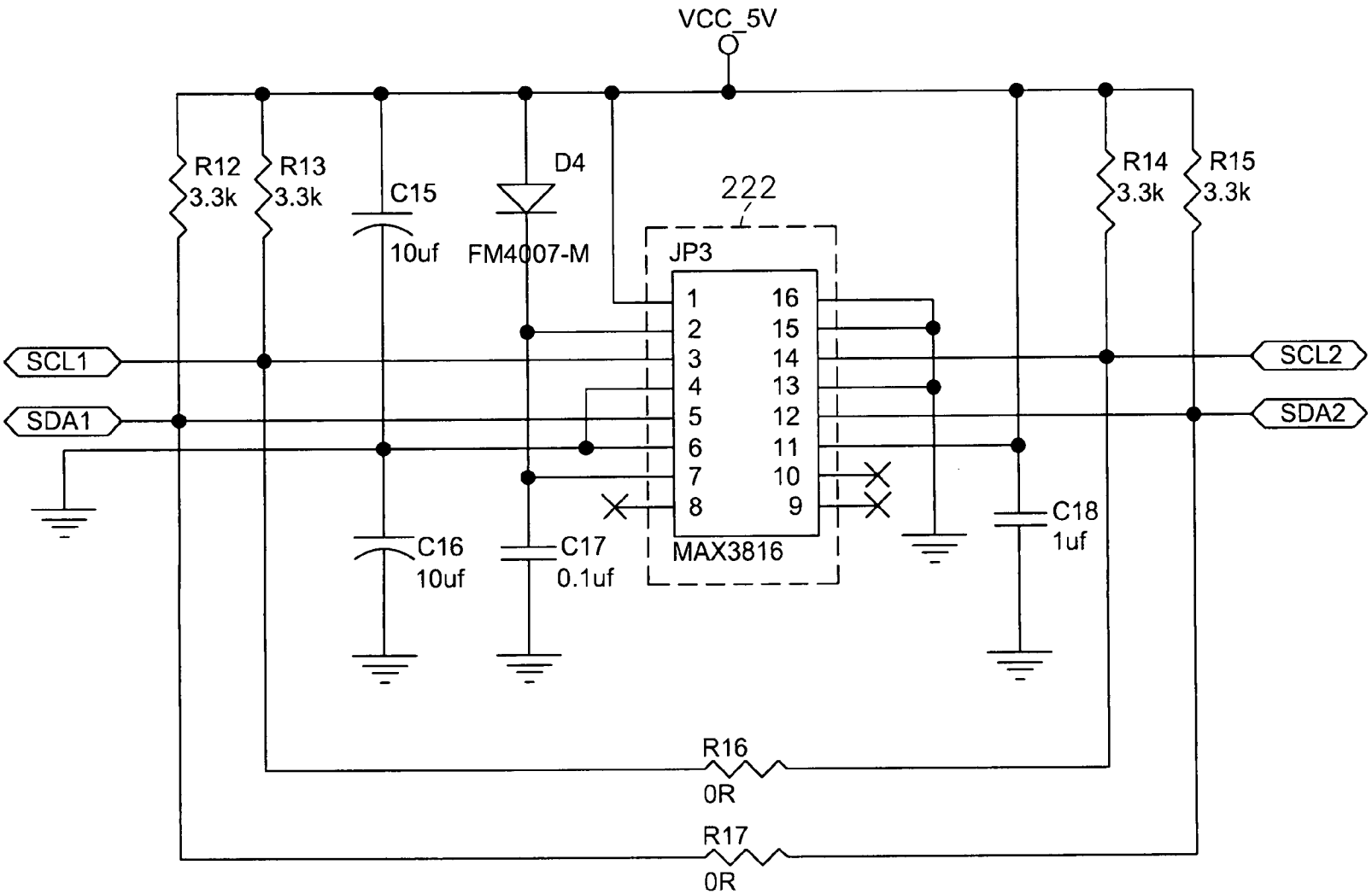
Figure 5:
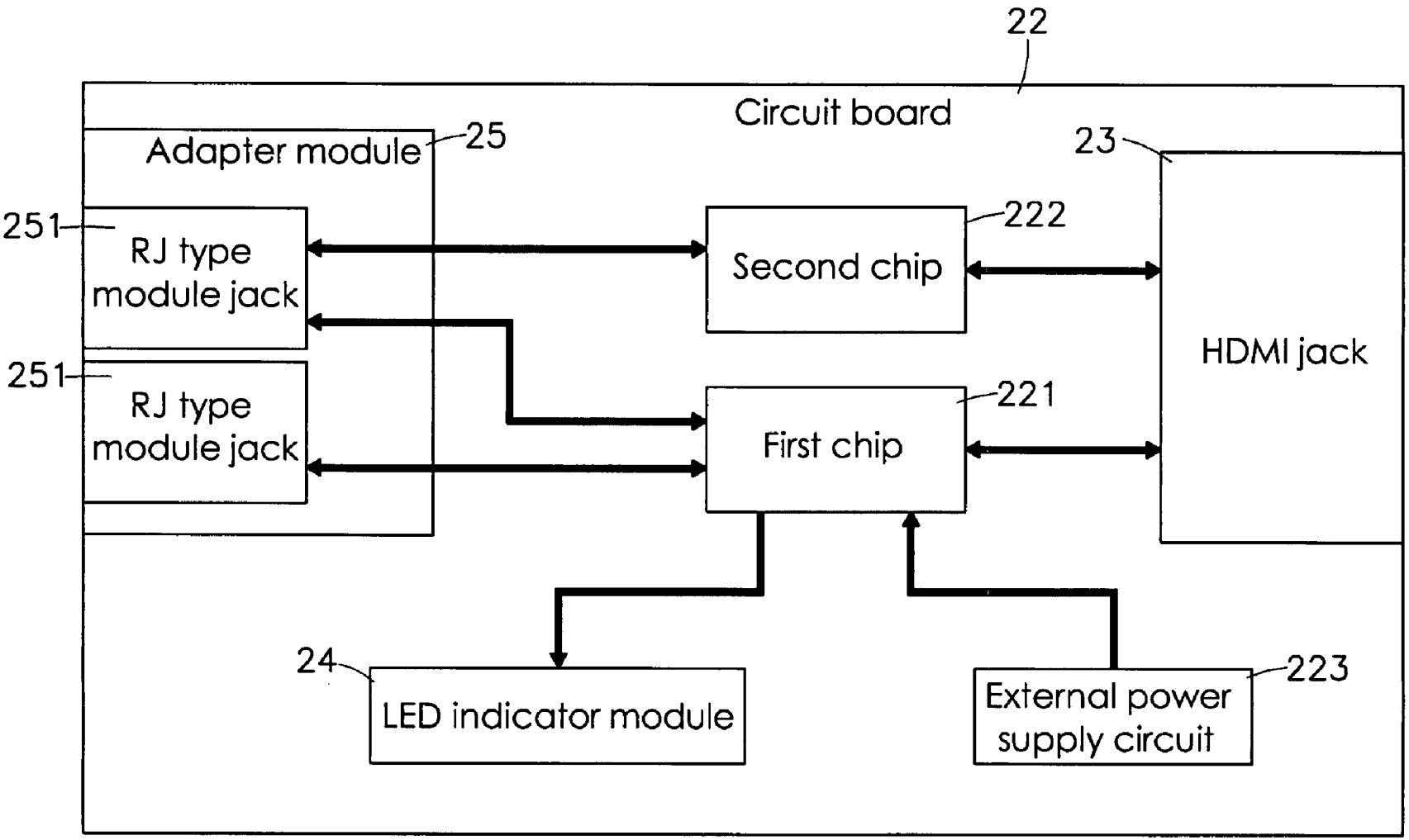
FIG. 5 is a circuit block diagram of the signal adapter of the wall plate assembly according to the present invention.

Referring to FIGS. 4~4K and 5, the circuit board 22 comprises a first chip 221 and a second chip 222 for signal compensation and amplification. The first chip 221 is electrically connected with an external power supply circuit 223 and the LED indicator module 24. The first chip 221 and the second chip 222 are respectively electrically connected with the HDMI jack 23. The first chip 221 is also electrically connected with the RJ type module jacks 251 of the adapter module 25. The second chip 222 is electrically connected with only one RJ type module jack 251 of the adapter module 25.

During signal transmission, signal attenuation may occur, and the status of signal attenuation will be more serious when the signal transmission distance is relatively increased. The invention uses the first chip 221 and the second chip 222 for signal compensation and amplification, eliminating the problem of signal attenuation during transmission and assuring signal transmission stability.

Referring to FIGS. 2, 4~4K and 5 again, the external power supply circuit 223 is connected to the power socket 26 at the bottom side of the base frame 21 of the signal adapter 2. Therefore, external power supply can be provided to the signal adapter 2 through the power socket 26. Further, the LEDs 241 of the LED indicator module 24 are adapted to indicate signal transmission status of the signal adapter 2. The light guides 242 of the LED indicator module 24 guide the light of the LEDs 241 to the through holes 121 of the wall plate 1. By means of the indication of the LED indicator module 24, a user can visually check the operation status of the signal adapter 2 of the wall plate assembly from the outside without detaching the wall plate assembly, and can take the necessary step immediately in case of a circuit failure.

Figure 6:
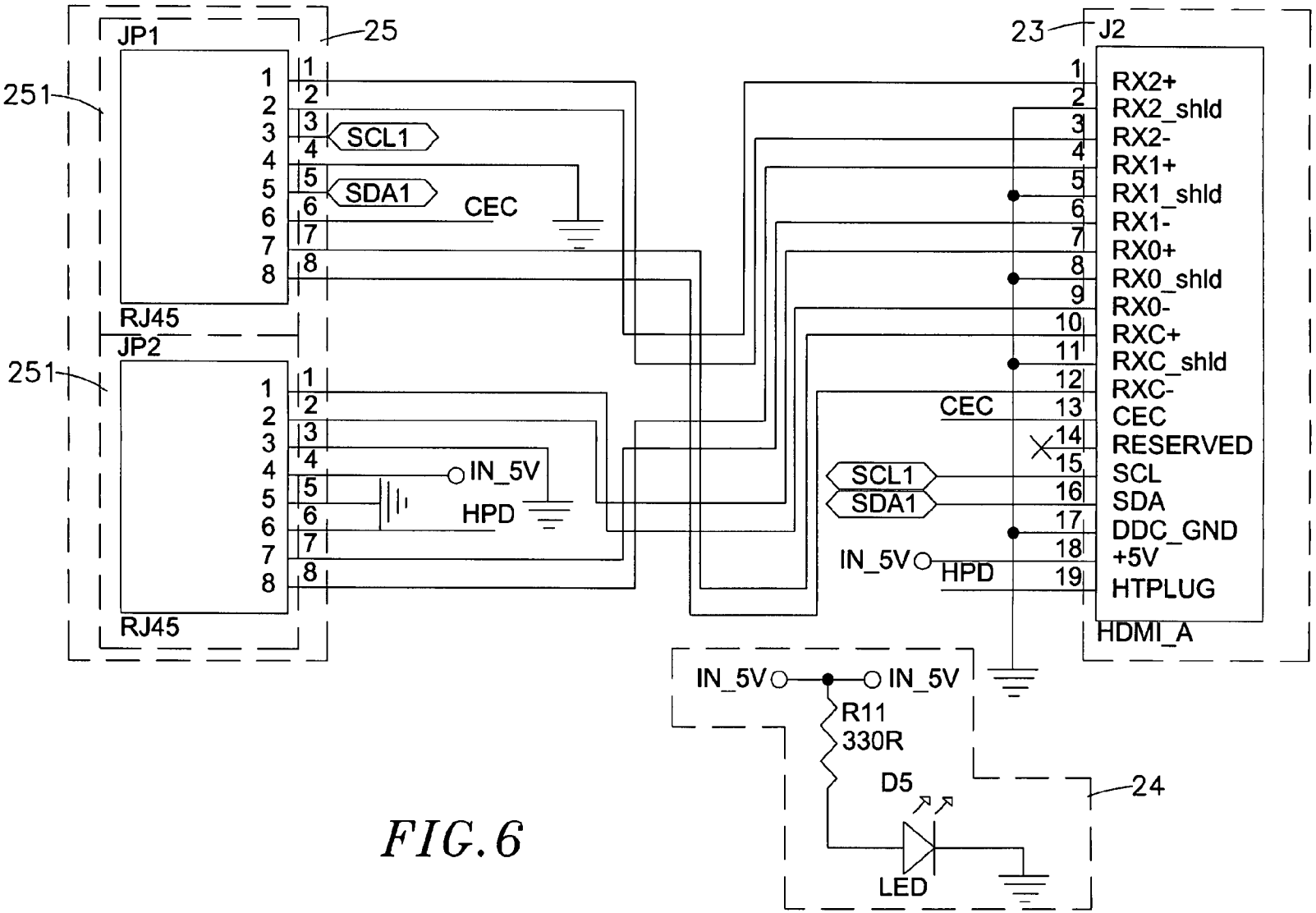
FIG. 6 is a circuit block diagram of an alternate form of the signal adapter of the wall plate assembly according to the present invention.

FIG. 6 is a circuit block diagram of an alternate form of the signal adapter of the wall plate assembly according to the present invention. As illustrated, the circuit board 22 has installed therein only the HDMI jack 23, the LED indicator module 24 and the adapter module 25. The RJ type module jacks 251 of the adapter module 25 are electrically connected to the HDMI jack 23. The LED indicator module 24 is electrically connected to the HDMI jack 23 and the RJ type module jacks 251 of the adapter module 25.

Referring to FIGS. 4~4K and 6 again, during circuit arrangement between the HDMI jack 23 and the RJ type module jacks 251 of the adapter module 25, the four pairs of electric wires of the HDMI jack 23 are set apart and respectively electrically connected to the RJ type module jacks 251 of the adapter module 25, preventing crosstalk interference.

Referring to FIGS. 1~3 again, the wall plate assembly of the present invention further comprises a support device 3 adapted for supporting a HDMI plug (not shown) that is inserted into the insertion slot 11 of the wall plate 1 and connected to the HDMI jack 23. The support device 3 is comprised of a first support frame 31 and a second support frame 32. The first support frame 31 and the second support frame 32 are movable relative to each other. The first support frame 31 has a horizontal panel 311 and a vertical panel 312 connected at right angles. The horizontal panel 311 has a bottom screw hole 3111, and two downwardly extending side wings 3112. The vertical panel 312 has vertical sliding slot 3121. The second support frame 32 is coupled to the bottom side of the horizontal panel 311 of the first support frame 31, having a flat horizontal base 321 and an upright wall 322 vertically extending from one side of the flat horizontal base 321. The flat horizontal base 321 has an elongated sliding slot 3211 cut through the top and bottom sides and extending in direction perpendicular to the upright wall 321. The upright wall 322 has an arched top notch 3221. The flat horizontal base 321 of the second support frame 32 is attached to the bottom side of the horizontal panel 311 of the first support frame 31 between the two side wings 3112, and then a screw 3222 is inserted through the elongated sliding slot 3221 and threaded into the bottom screw hole 3111 to lock the second support frame 32 to the first support frame 31. When loosened the screw 3222, the user can move the second support frame 32 relative to the first support frame 31 to adjust the horizontal width of the support device 3.

The first support frame 31 of the support device 3 is fitted into the front recess 12 of the wall plate 1, and a screw 3122 is inserted through the vertical sliding slot 3121 and threaded into the screw hole 122 to lock the first support frame 31 to the wall plate 1 at the desired elevation.

Referring to FIGS. 7 and 2 again, the wall plate assembly is adapted to receive a HDMI plug 4 at one end of a HDMI cable 42. During installation, the HDMI jack 4 is supported on the horizontal panel 311 of the first support frame 31 inserted through the insertion slot 11 of the wall plate 1 into the HDMI jack 23 and the HDMI cable 42 positioned in the arched top notch 3221 of the upright wall 322 of the second support frame 32 of the support device 3. Thus, the HDMI plug 4 is electrically connected to the HDMI jack 23 of the signal adapter 2. At the same time, the RJ type module jacks 251 of the adapter module 25 are connected to RJ type module plugs 5 with RJ type cables 51.

When a different size of HDMI plug 4 is used, the screw 3122 can be loosened for allowing adjustment of the elevation of the first support frame 31 relative to the wall plate 1 to let the HDMI plug 4 be inserted through the insertion slot 11 of the wall plate 1 into the HDMI jack 3, and the screw 3222 can be loosened for allowing adjustment of the second support frame 32 relative to the first support frame 31 to have the HDMI plug 4 be positively supported on the horizontal panel 311 of the first support frame 31 and stopped between the wall plate 1 and the upright wall 322 of the second support frame 32. After adjustment, the screws 3122 and 3222 are respectively fastened tight to lock the first support frame 31 to the wall plate 1 and the second support frame 32 to the first support frame 21 respectively.

Figure 8:
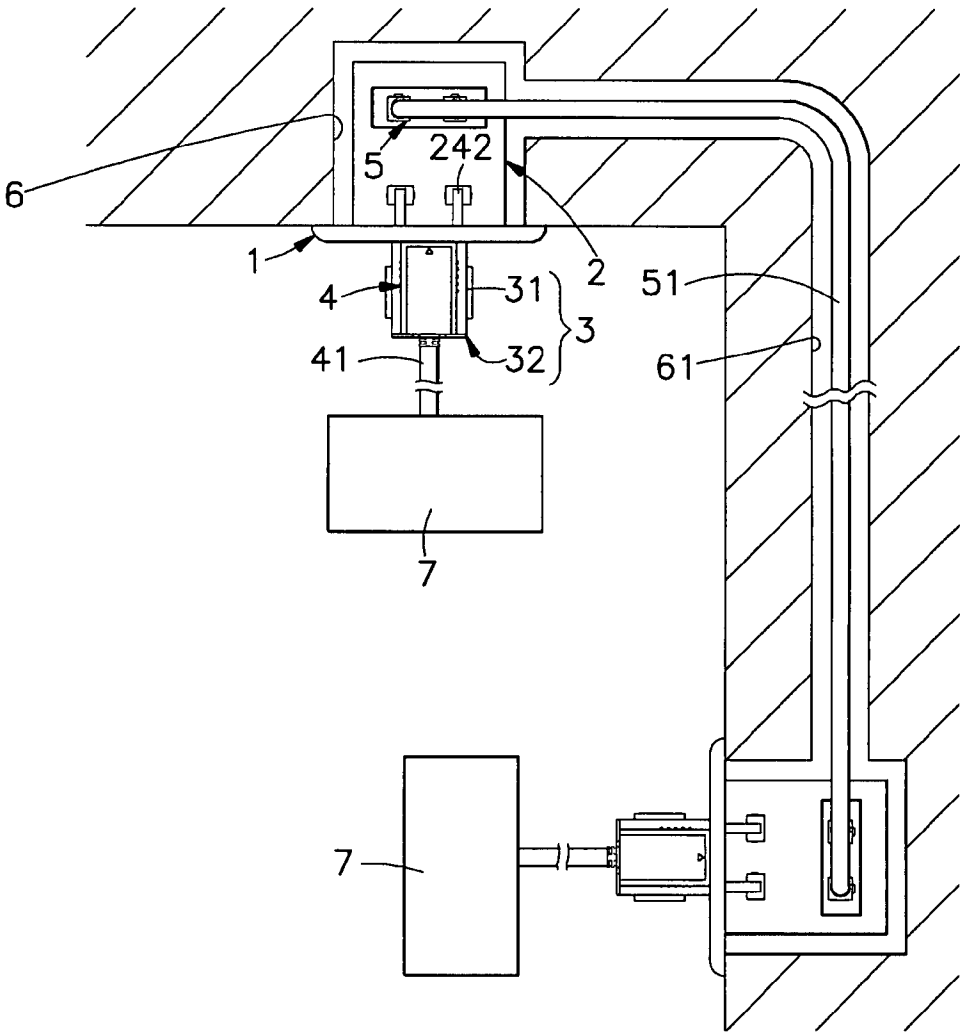
FIG. 8 is a schematic drawing showing an application example of the present invention.

Referring to FIGS. 8 and 7 again, the screws 131 that are mounted in the mounting through holes 13 of the wall plate 1 and the mounting through holes 273 of the mounting plate 27 are fastened to the ceiling, wall or floor to affix the wall plate assembly in place, holding the signal adapter 2 is a box 6 inside the ceiling, wall or floor. When two wall plate assemblies are installed in the ceiling, wall or floor at different locations, and the RJ type module plugs 5 respectively at the distal ends of the RJ type cables 51 are respectively connected to the RJ type module jacks 251 of the adapter modules 25 of the signal adapters 2 of the two wall plate assemblies for signal transmission between the signal adapters 2 of the two wall plate assemblies. Further, a pipe 61 is connected between the two boxes 6, and the RJ type cables 51 are inserted through the pipe 61 and connected between the RJ type module jacks 251 of the adapter modules 25 of the signal adapters 2 of the two wall plate assemblies. Because the RJ type cables 51 have the characteristics of high flexibility and small diameter, the wiring arrangement is easy. Further, if the RJ type cables 51 are too long, they can be wound round to shorten the length and the part that is wound part can be received in the box 6.

When in use, the HDMI plug 4 of the HDMI cable 41 that is connected to an electronic device 7 (such as LCD monitor, plasma monitor, multimedia player, VCD player, DVD player, projector, video tape recorder and player, etc) is connected to the HDMI jack 23 of the signal adapter 2. Because the effective transmission distance of the RJ type cable 51 reaches 100 meters and the HDMI cable 41 causes signal attenuation when over 10 meters, the invention uses the RJ type cables 51 to transmit signal between the signal adapters 2 of two wall plate assemblies at different locations, eliminating the problem of signal attenuation. Further, because the cost of the RJ type cable 51 is much lower than the HDMI cable 41, the invention saves much the installation cost.

In the aforesaid embodiments, the wall plate 1 has only one insertion slot 11, and the signal adapter 2 includes only one HDMI jack 23. Alternatively, the signal adapter 2 can provide multiple HDMI jacks 23 respectively connected to a respective insertion slot 11 on the wall plate 1.

As stated above, the invention provides a wall plate assembly that comprises a wall plate 1 and a signal adapter 2 at the back side of the wall plate 1. The signal adapter 2 comprises a base frame 21 holding a circuit board 22. The circuit board 22 has installed therein a HDMI jack 23 at the front side and an adapter module 25 with multiple RJ type module jacks 251 at the rear side. RJ type cables 51 can be used and connected between the RJ type module jacks 251 of the adapter modules 25 of the signal adapters 2 of two wall plate assemblies for signal transmission between the signal adapters 2 of two wall plate assemblies that are installed in two far apart locations, eliminating the problem of signal attenuation during transmission.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A wall plate assembly comprising:

a wall plate, said wall plate comprising at least one insertion slot cut through front and back sides thereof for the insertion of at least one HDMI (High-Definition Multimedia Interface) plug, and a front recess on said front side thereof and a support device fastened to said front recess for supporting said at least one HDMI plus in said at least one insertion slot, said support device comprising a first support frame fastened to said front recess of said wall plate below the elevation of said at least one insertion slot, and a second support frame horizontally adjustable coupled to said first support frame; and a signal adapter fixedly provided at the back side of said wall plate, said signal adapter comprising a base frame affixed to the back side of said wall plate, a circuit board mounted on said base frame, at least one HDMI (High-Definition Multimedia Interface) jack installed in said circuit board and respectively attached to said at least one insertion slot of said wall plate for receiving said at least one HDMI plug, and an adapter module installed in said circuit board and electrically connected to said at least one HDMI jack for the connection of at least one RJ type module plug.

2. The wall plate assembly as claimed in claim 1, wherein said first support frame comprises a vertical sliding slot, a bottom screw hole, and a screw inserted through said vertical sliding slot and fastened to said front recess of said wall plate to adjustably lock said first support frame to said wall plate; said second support frame comprises an elongated horizontal sliding slot and a screw inserted through said elongated horizontal sliding slot and fastened to said bottom screw hole of said first support frame to lock said second support frame to said first support frame.

3. The wall plate assembly as claimed in claim 2, wherein said second support frame comprises an upright wall perpendicularly upwardly extending from one side thereof remote from said first support frame, and an arched notch on a top side of said upright wall for supporting a respective HDMI cable that has a respective HDMI plug inserted through said at least one insertion slot of said wall plate into said at least one HDMI jack of said signal adapter.

4. The wall plate assembly as claimed in claim 1, wherein said wall plate comprises at least one through hole; said signal adapter comprises at least one indicator module installed in said circuit board, said at least one indicator module each comprising an indicator light installed in said circuit board and at least one light guide respectively connected to said through holes of said wall plate and adapted for guiding light from said at least one indicator light to said through holes of said wall plate.

5. The wall plate assembly as claimed in claim 1, wherein said circuit board comprises a first chip and a second chip and electrically connected with said HDMI jack and said adapter module for signal compensation and amplification.

6. The wall plate assembly as claimed in claim 1, wherein said wall plate comprises a plurality of mounting through holes and a plurality of fastening members respectively mounted in said mounting through holes to affix said wall plate to a support.

7. The wall plate assembly as claimed in claim 1, wherein said base frame of said signal adapter comprises a front mounting panel vertically downwardly extending from a front side thereof and affixed to the back side of said wall plate.

8. The wall plate assembly as claimed in claim 7 wherein said wall plate comprises a power plug hole; said base frame of said signal adapter comprises a lug perpendicularly backwardly extending from said front mounting flange for holding a power socket corresponding to said power plug hole.

9. The wall plate assembly as claimed in claim 1, wherein said signal adapter comprises a cover plate covering said base frame.

10. The wall plate assembly as claimed in claim 1, wherein said signal adapter comprises a cover plate formed integral with said base frame.

11. The wall plate assembly as claimed in claim 1, wherein said adapter module comprises at least one RJ type module jack for the connection of a RJ type module plug respectively.

12. The wall plate assembly as claimed in claim 1, further comprising a mounting plate fixedly connected between said base frame of said signal adapter and the back side of said wall plate.

* * * * *